United States Patent [19]

Wiegel

[11] Patent Number: 4,726,068

[45] Date of Patent: Feb. 16, 1988

[54] BOOM MOUNTED MICROPHONE AND CONNECTOR

[75] Inventor: Christopher D. Wiegel, Minneapolis, Minn.

[73] Assignee: Telex Communications, Inc., Minneapolis, Minn.

[21] Appl. No.: 934,124

[22] Filed: Nov. 24, 1986

[51] Int. Cl.[4] ..... H04R 1/04; H04R 1/02; H04R 1/08

[52] U.S. Cl. ..... 381/169; 381/184

[58] Field of Search ..... 379/430, 449; 381/168, 381/169, 188, 205, 183, 187

[56] References Cited

U.S. PATENT DOCUMENTS

| | | | |
|---|---|---|---|
| 2,773,942 | 12/1956 | Christensen | 381/168 |
| 2,787,675 | 4/1957 | Meshirer et al. | 381/168 |
| 3,781,492 | 12/1973 | Cragg et al. | 379/430 |
| 4,551,854 | 11/1985 | Rutty et al. | 455/89 |

FOREIGN PATENT DOCUMENTS

| | | | |
|---|---|---|---|
| 279696 | 3/1970 | Austria | 381/168 |
| 2053449 | 5/1972 | Fed. Rep. of Germany | 381/169 |
| 2138750 | 2/1973 | Fed. Rep. of Germany | 381/168 |

*Primary Examiner*—Jin F. Ng
*Assistant Examiner*—Danita R. Byrd
*Attorney, Agent, or Firm*—Sturm & Baker

[57] ABSTRACT

A boom mounted microphone includes a boom mounted plug and connectors for connection to and supporting a microphone disposed in a two part housing that is divided into a socket for receiving said plug for locking physical support as well as conductive electrical connection, and a plurality of consecutive, adjacently disposed compartments, including at least a pair disposed parallel to the longitudinal axis, opening into the socket and containing conductive sockets for conductively receiving the connectors on the plug, a compartment for receiving a signal processing board and a compartment for mounting a microphone, the side walls, socket and compartments formed by complementary disposed walls of each housing and includes screw threaded fastening means extending through one wall of one part of the housing into the conductive sockets and in engagement with the connectors on the plug.

9 Claims, 9 Drawing Figures

BOOM MOUNTED MICROPHONE AND CONNECTOR

BACKGROUND OF THE INVENTION

This invention relates to boom mounted microphones and is particularly directed to miniature and micro-miniature microphones to be disposed on the end of a small boom to be adjustably positioned relative a mounting on a headset, or headband, and the mouth of a user. My invention is particularly directed to a microphone that is safe and secure in operation under extreme conditions of environmental use and is easily replaced or repaired to restore an inoperative microphone to full operational status.

Prior Art

Prior art communications devices of the miniature and micro-miniature type have either utilized a sound tube for conducting sound from the mouth of a user to a microphone disposed in a remotely positioned location on a headset or the body of a user or have disposed a microphone assembly on the end of boom for more efficient operation under various environmental conditions. In the type of environment where a microphone is disposed on the end of a boom to be positioned adjacent the mouth of a user, prior art devices have used large enclosures for a microphone to provide physical characteristics that will stand up under ordinary use and/or complicated boom structures to adequately support a microphone. Many, if not all, of the prior art designs have suffered from an economic disadvantage, undue complexity and/or operational insecurity with resultant premature failure of a communications device. Many such devices were simply mounted on the end of a boom by various and sundry arrangements which fell off and/or became loose through use and ultimately prematurely failed to remain operative.

BRIEF SUMMARY OF THE INVENTION

My invention provides a microphone comprised of two parts, a first part that may be described as a plug that is securely, stationarily and non-rotatably disposed or mounted on the end of a microphone boom structure to be attached to and suspended from, for example, a headset and a removable housing containing a microphone and suitable electronics to be removably mounted on the outer end of the plug and lockably secured thereto. A housing containing the microphone and signal processing means is divided into a plurality of compartments and includes a plug receiving socket adjacent a pair of compartments containing a pair of contacts lined with conductive material which are adapted to receive transversely extending screw-threaded locking members to provide for a secure assembly that may be easily disassembled for repair or replacement while maintaining the structural integrity of the boom mounted microphone.

DESCRIPTION OF THE ILLUSTRATED EMBODIMENT

Figure 9:
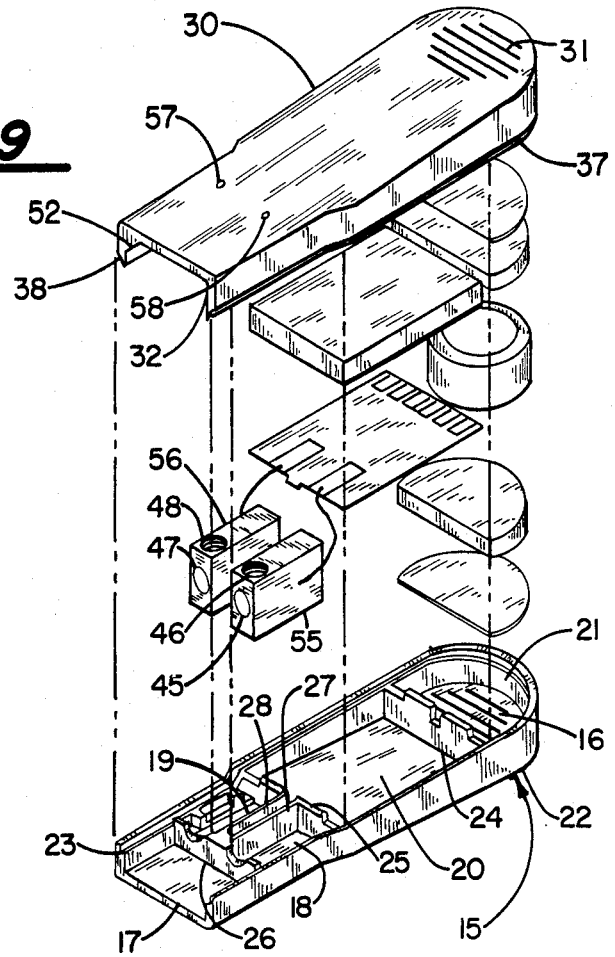
FIG. 9 is an exploded assembly view of a portion of my microphone.
Figure 1:
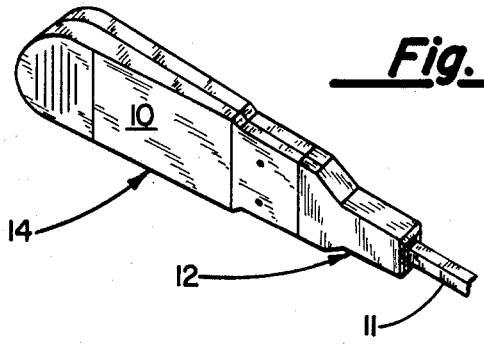
FIG. 1 is a perspective sketch of my improved microphone operatively disposed on a fragmentary section of a microphone boom.
Figure 2:
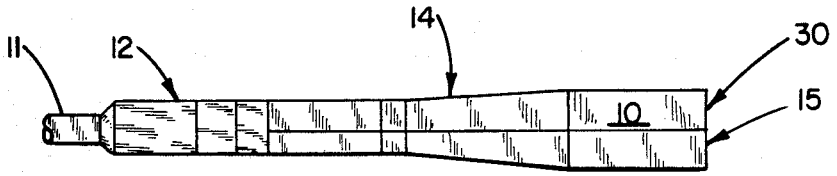
FIG. 2 is a side elevational view of the microphone assembly shown on FIG. 1.
Figure 3:
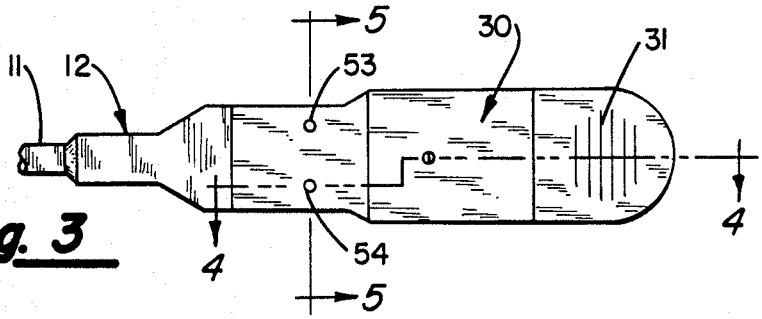
FIG. 3 is a top plan view thereof.

Referring now to the drawings in which like elements have been identified by like reference characters, my microphone is indicated generally by reference character 10 and is comprised of a plug 12 disposed, as by molding, on a non-circular microphone boom end 11 and a microphone housing 14 having bottom portion 15 and top portion 30.

At the onset, it may be seen from reference to the exploded assembly view of the FIG. 9, that bottom 15 and top 30 are intended to be assembled into a completed housing 14 that is then assembled to and mounted upon the outer end of plug 12.

Bottom 15 includes a plurality of slots 16 for transmitting sound energy to a microphone disposed interiorly of and adjacent to slots 16, a plurality of cavities 17, 18, 19, 20 and 21 that are defined by a peripheral wall, having a lip adapted to mate with and be received by a complementary disposed lip on top 30, in conjunction with intermediate walls 24, 25, 26, 27 and 28.

Similarly, top portion 30 is provided with a plurality of transversely extending slots 31, a corresponding plurality of cavities 32, 33, 34, 35 and 36 as defined by peripheral wall 37, having a lip portion 38 adapted to coact with and mate with complementary configured lip 23 on bottom 15, a plurality of intermediate side walls 40, 41, 42, 43 and 44, and apertures 57 and 58.

Figure 4:
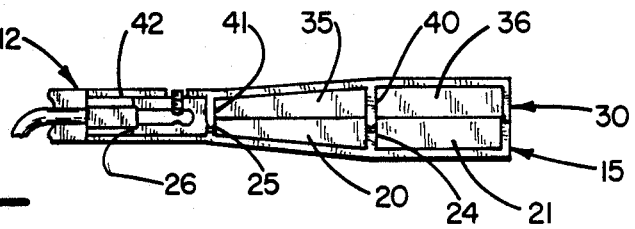
FIG. 4 is a sectional view taken along section line 4—4 on FIG. 3 of the drawings.
Figure 5:
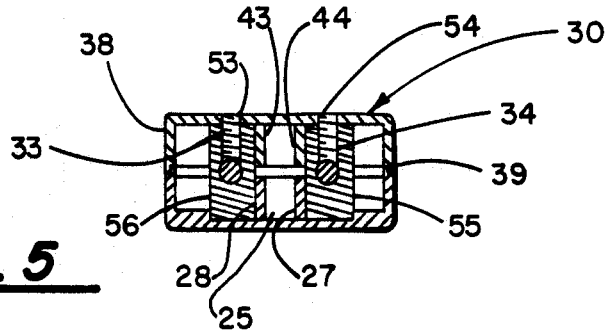
FIG. 5 is a sectional view taken along section line 5—5 on FIG. 3 of the drawings.

Referring again to FIG. 9, the exploded assembly view includes a terminal block 55 having a first conductively lined aperture terminal 45 and a transversely extending screw-threaded locking hole 46 and a second terminal block 56 having a conductively lined terminal aperture 47 and a transversely extending locking hole 48. Also shown are a signal processing board, typically containing integrated circut elements and the like and a transducer, all of which are interconnected by suitable conductors to aperture terminals 45 and 47 in blocks 55 and 56 and suitably configured spacers are provided to be assembled into overlying juxtaposition with the several elements to be assembled into microphone housing 14. In an assembled state, it may be seen that cavities 17 and 32 serve to define a longitudinally extending outwardly opening socket extending from intermediate walls 26 and 42 that is further provided with an inwardly extending portion 52 (disposed in top 30) to receive and coact with a complementary configured surface 51 on plug 12. Connector blocks 55 and 56 are disposed in the corresponding cavities in bottom and top members 15 and 30 for conductively receiving pin members 49 and 50 on plug 12 within aperture terminals 45 and 47 as illustrated in the sectional views of FIGS. 4 and 5 in which certain of the elements of the microphone have been omitted for clarity.

Plug 12 is shown comprised of a longitudinally elongated insulating body suitably non-rotatably and stationarily mounted as by molding onto the end of microphone boom 11 and in which conductive pins 49 and 50, connected to suitable conductors extending through the interior of boom 11, are likewise molded. The intermediate portion of plug 12 is sized and configured to fit into the open end of assembled housing 14 and includes a chamfered portion 51 adapted to mate and coact with surface 52 in microphone housing 14 to ensure that plug 12 is assembled to microphone housing 14 in the correct relationship to preserve, for example, the polarity that may be associated with conductive pins 49 and 50.

Figure 6:
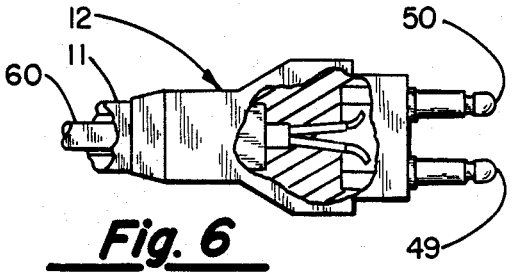
FIG. 6 is a top plan view with portions removed of the plug portion of my microphone.
Figure 7:
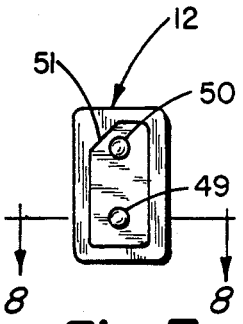
FIG. 7 is a side elevational view of FIG. 6.
Figure 8:
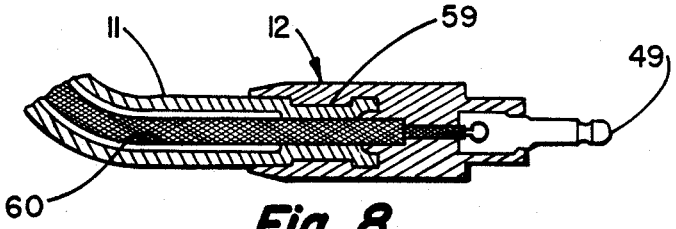
FIG. 8 is a sectional view taken along section lines 8—8 on FIG. 7.

In one operative embodiment of my invention, a plug 12 was mounted on the end of boom 11 by disposing a mold cavity therearound after conductor 60 was extended through boom 11 and connected to pins 49 and 50 which, in turn were disposed in the positions shown on, for example, FIGS. 6, 7 and 8, within the mold cavity by suitable means and boom 11 was crimped as indicated by reference character 59 on FIG. 8 adjacent its end and within the mold cavity to provide a locking engagement with the body of plug 12 as well as to inhibit entry of the molding material past conductor 60 and into the outwardly extending end of boom 11. This configuration not only provides a secure mounting for microphone housing 14, but maintains the integrity and security of the wiring extending through the microphone boom and eliminates the necessity for separate connections as may be done manually or by the use of ancillary, separate plugs and jacks or the like.

After plug 12 has been inserted into the end of microphone housing 14, a pair of locking screws 53 and 54 are threadably inserted into apertures 48 and 46 in connector blocks 56 and 55 into locking engagement with the portions of pins 49 and 50 as disposed in apertures 47 and 45.

The completed assembly of plug 12 and microphone housing 14 may be seen to provide an integral unit that is secure and efficient under normal and extreme conditions of operation while permitting disassembly and reassembly in a facile manner in the event repair or replacement is necessary.

I claim:

1. A boom mounted microphone comprising in combination;

a hollow housing including a microphone conductively connected to a socket extending into said housing;

a plug having one end stationarily disposed on an end of a microphone boom and including conductive means extending longitudinally therethrough to be received in said socket; and locking means extending through said housing and socket into engagement with the conductive means in said plug.

2. The subject matter of claim 1 in which the hollow housing is comprised of longitudinally elongated top and bottom members, each having complementary disposed side walls to define interior cavities, one of said cavities having an open end to comprise the socket for receiving the plug.

3. The subject matter of claim 2 in which a pair of cavities are disposed in parallel relationship adjacent the closed end of the socket cavity, include a side wall opening into said socket cavity and conductive means connected to said microphone.

4. The subject matter of claim 3 in which locking means extend through the housing, said pair of cavities and the conductive means in the pair of cavities.

5. The subject matter of claim 4 in which the locking means are comprised of screw threaded fasteners.

6. The subject matter of claim 2 in which the top and bottom housing members include a complementary configured lip adapted to be sealably interconnected.

7. The subject matter of claim 3 in which the top and bottom housing members include a complementary configured lip adapted to be sealably interconnected.

8. The subject matter of claim 4 in which the top and bottom housing members include a complementary configured lip adapted to be sealably interconnected.

9. The subject matter of claim 5 in which the top and bottom housing members include a complementary configured lip adapted to be sealably interconnected.

* * * * *